US010614673B2

(12) United States Patent
Pececnik

(10) Patent No.: US 10,614,673 B2
(45) Date of Patent: Apr. 7, 2020

(54) MULTI-FUNCTIONAL PLAYING CARD RANDOMIZATION SYSTEM

(71) Applicant: Interblock D.D., Menges (SI)

(72) Inventor: Joze Pececnik, Smarca (SI)

(73) Assignee: INTERBLOCK D.D., Menges (SI)

( * ) Notice: Subject to any disclaimer, the term of this patent is extended or adjusted under 35 U.S.C. 154(b) by 83 days.

(21) Appl. No.: 15/131,214

(22) Filed: Apr. 18, 2016

(65) Prior Publication Data

US 2017/0301188 A1 Oct. 19, 2017

(51) Int. Cl.

| | |
|---|---|
| ***G07F 17/32*** | (2006.01) |
| ***A63F 1/12*** | (2006.01) |
| ***A63F 9/24*** | (2006.01) |

(52) U.S. Cl.

CPC ..... *G07F 17/3293* (2013.01); *A63F 1/12* (2013.01); *A63F 9/24* (2013.01); *G07F 17/3244* (2013.01)

(58) Field of Classification Search

CPC ..... A63F 1/12; A63F 1/14; G07F 17/3293
See application file for complete search history.

(56) References Cited

U.S. PATENT DOCUMENTS 6,250,632 B1 * 6/2001 Albrecht ..... A63F 1/12 273/149 P
8,142,271 B2 * 3/2012 Kuhn ..... A63F 3/00157 463/10
8,342,533 B2 * 1/2013 Fleckenstein ..... A63F 1/00 273/148 A
8,506,376 B2 * 8/2013 Kuhn ..... A63F 3/00157 463/11
8,602,417 B2 * 12/2013 Farrow ..... G07F 17/3293 273/292
2004/0224777 A1 * 11/2004 Smith ..... A63F 1/00 463/47
2006/0287101 A1 * 12/2006 Crawford, III ..... G07F 17/32 463/42
2007/0278739 A1 * 12/2007 Swanson ..... A63F 1/12 273/149 R
2009/0017888 A1 * 1/2009 Kuhn ..... A63F 3/00157 463/13

(Continued)

FOREIGN PATENT DOCUMENTS

WO WO 2010055328 A1 * 5/2010 ..... A63F 1/14

*Primary Examiner* — David Duffy
(74) *Attorney, Agent, or Firm* — BakerHostetler

(57) ABSTRACT

A convertible gaming system that can be switched for different methods between fully automatic play with no live dealer and semi-automatic play with a live dealer and electronic wagering from player input controls. The system may include a table top; multiple independent player input positions; and a processor. Both an automatic card randomization and delivery for view-only system, and a semi-automatic system including communication link on the table top for engagement with a delivery shoe having or providing knowledge of playing card suit and rank for delivery to multiple independent player positions for use in a wagering event are provided. The processor is configured to determine individual hand count and/or hand rank at the multiple independent player positions for use in determining wagering event outcomes whether the playing card hand count or hand rank is transmitted from the automatic system or the semi-automatic system.

22 Claims, 3 Drawing Sheets

(56) References Cited

U.S. PATENT DOCUMENTS

| | | | | |
|---|---|---|---|---|
| 2009/0115133 | A1* | 5/2009 | Kelly | G07F 17/32 273/274 |
| 2009/0124317 | A1* | 5/2009 | Dinkla | A63F 3/00157 463/13 |
| 2009/0191933 | A1* | 7/2009 | French | G07F 17/32 463/12 |
| 2012/0129611 | A1* | 5/2012 | Rasmussen | G07F 17/3218 463/43 |
| 2012/0238338 | A1* | 9/2012 | Kuhn | A63F 3/00157 463/11 |
| 2013/0178266 | A1* | 7/2013 | Farrow | G07F 17/3293 463/12 |
| 2013/0196729 | A1* | 8/2013 | Krise | G07F 17/3262 463/11 |

* cited by examiner

MULTI-FUNCTIONAL PLAYING CARD RANDOMIZATION SYSTEM

BACKGROUND OF THE INVENTION

1. Field of the Invention

The present invention relates to the field of gaming and particularly to gaming that uses random playing cards in the provision of random event outcomes and more particularly to gaming systems having playing card randomization apparatus.

2. Background of the Art

Playing card games are a fundamental segment of the gaming industry, and many variations of games including blackjack, baccarat, poker and variants games are staple fixtures in casinos throughout the world.

An essential aspect of gaming events with playing cards is that the cards be provided to hand positions as random playing cards so that there is no definite predictability about individual playing cards or hands of playing cards at individual player, dealer or banker hand positions. Random cards out of a single deck of playing cards were generally provided in a standard deck of 52 playing cards that were manually shuffled and then manually dealt to hand positions. Manual shuffling was found to have numerous problems that were disadvantageous to the integrity of the gaming event. Inadequate shuffling, accidental display of cards, intentional manipulation of card delivery and card counting are among the problems created by manual shuffling and distribution of playing cards.

Mechanical shuffling devices have been proposed and used to reduce some of the problems noted above and to speed up play of the wagering events. Many different types of randomizing or shuffling apparatus have been developed to provide improved delivery of random playing cards. Different mechanisms that simulated riffling of cards, random assorting of playing cards into stacks, random insertion/removal of playing cards from compartments in carousels or stacks, and random ejection of cards from sets of playing cards have been used to provide random cards or random hands of cards. Playing card randomization is performed in batch or continuous process operations.

Among the patents that describe randomization systems for playing cards are as follows. U.S. Pat. No. 8,025,294, "Card shuffler with card rank and value reading capability;" U.S. Pat. Nos. 8,012,029 and 7,735,657 (carousel shufflers); U.S. Pat. No. 8,011,661, "Shuffler with shuffling completion indicator;" U.S. Pat. No. 7,976,023, "Image capturing card shuffler;" U.S. Pat. No. 7,967,294, "Card shuffler with gravity feed system for playing cards;" U.S. Pat. Nos. 7,933,448 and 7,764,836, "Card reading system employing CMOS reader;" U.S. Pat. No. 7,933,444, "Method of locating rank and suit symbols on cards;" U.S. Pat. No. 7,784,790, "Device and method for continuously shuffling and monitoring cards;" U.S. Pat. No. 7,769,232, "Unique sensing system and method for reading playing cards;" U.S. Pat. No. 7,764,836, "Multiple mode card shuffler and card reading device;" U.S. Pat. No. 7,407,438, "Modular dealing shoe for casino table card games;" U.S. Pat. No. 7,717,427, "Playing card dealing shoe with automated internal card feeding and card reading;" U.S. Pat. No. 7,677,565, "Card shuffler with card rank and value reading capability;" U.S. Pat. No. 7,661,676, "Card shuffler with reading capability integrated into multiplayer automated gaming table;" U.S. Pat. No. 7,584,962, "Card shuffler with jam recovery and display;" U.S. Pat. No. 7,338,044, "Card shuffler with user game selection input;" U.S. Pat. No. 7,523,936, "Device and method for forming and delivering hands from randomly arranged decks of playing cards;" U.S. Pat. No. 7,523,935, "Card shuffling apparatus with integral card delivery;" U.S. Pat. No. 7,413,191, "Device and method for forming and delivering hands from randomly arranged decks of playing cards;" U.S. Pat. No. 7,367,561, "Card shuffler;" (including carousel shufflers); U.S. Pat. No. 7,322,576, "Device and method for continuously shuffling and monitoring cards;" U.S. Pat. No. 7,261,294, "Playing card shuffler with differential hand count capability;" U.S. Pat. No. 7,255,344, "Device and method for continuously shuffling and monitoring cards;" U.S. Pat. No. 7,114,718, "Smart table card hand identification method and apparatus;" U.S. Pat. No. 7,073,791, "Hand forming shuffler with on demand hand delivery;" U.S. Pat. No. 7,059,602, "Card shuffler with staging area for collecting groups of cards;" U.S. Pat. No. 6,889,979, "Card shuffler;" U.S. Pat. No. 6,655,684, "Device and method for forming and delivering hands from randomly arranged decks of playing cards;" U.S. Pat. No. 6,267,248, "Collating and sorting apparatus;" U.S. Pat. No. 6,676,127, "Collating and sorting apparatus;" U.S. Pat. No. 6,254,096, "Device and method for continuously shuffling cards;" U.S. Pat. No. 6,149,154, "Device and method for forming hands of randomly arranged cards;" U.S. Pat. No. 6,588,750, "Device and method for forming hands of randomly arranged decks of cards;" U.S. Pat. Nos. 6,651,982 and 6,651,981, "Card shuffling apparatus with integral card delivery;" U.S. Pat. Nos. 7,669,852 and 7,594,660, "Automatic card shuffler;" and the like.

U.S. Pat. No. 8,360,431 (Pececnik) describes a shuffling apparatus with some automated capability in which there are at least three card holders, each adapted to hold at least one deck of cards; a conveying mechanism adapted to convey cards between each card holder and at least two other card holders, the conveying mechanism controllable to select a destination card holder of the at least two card holders; and a controller arranged to control the conveying mechanism in a shuffling mode in which cards are sent between a source card holder and selected ones of the at least two destination card holders.

These patent disclosures are incorporated herein in their entirety by reference.

SUMMARY OF THE INVENTION

A convertible gaming system that can be switched for different methods between fully automatic play with no live dealer and semi-automatic play with a live dealer and electronic wagering from player input controls. The system may include:

- a table top;
- multiple independent player input positions;
- a processor in communication with the multiple independent player input positions;
- an automatic card randomization and delivery for view-only system, with a randomization component under a table top for the system, and the randomization component in communication with the multiple independent player input positions;
- and a semi-automatic system including communication link on the table top for engagement with a delivery shoe having or providing knowledge of playing card suit and rank for delivery to multiple independent player positions for use in a wagering event, the communication transmitting the knowledge of playing card suit and rank to the processor;

the processor configured to determine individual hand count and/or hand rank at the multiple independent player positions for use in determining wagering event outcomes whether the playing card hand count or hand rank is transmitted from the automatic system or the semi-automatic system.

A method and system for altering delivery of random events on a gaming table and a system for enabling that method. The method may be practiced by:

a) providing a gaming system that includes:

a. a playing card moving system that moves individual playing cards from a first physical position to at least a second physical position; and b. a playing card reading system that reads suit and rank of the individual playing cards during movement of the individual playing cards from the first physical position to the at least second physical position;

c. the playing card reading system transmitting read suit and rank values to a processor;

d. the processor identifying, creating or recording a random order or distribution of playing cards;

e. the gaming system displaying random combinations of playing cards to at least respective multiple independent player positions on a gaming table by i) providing random physical playing cards from the at least second physical position or ii) the processor transmitting information to a display system visible at each of the at least respective multiple independent player positions on a gaming table;

wherein after displaying of at least one random combination of playing cards to at least respective multiple independent player positions on a gaming table by i), mode of delivery of a second random combination of playing cards to at least respective multiple independent player positions on a gaming table is performed by ii), or wherein after displaying of at least one random combination of playing cards to at least respective multiple independent player positions on a gaming table by ii), mode of delivery of a second random combination of playing cards to at least respective multiple independent player positions on a gaming table is performed by i).

DETAILED DESCRIPTION OF THE INVENTION

Figure 1:
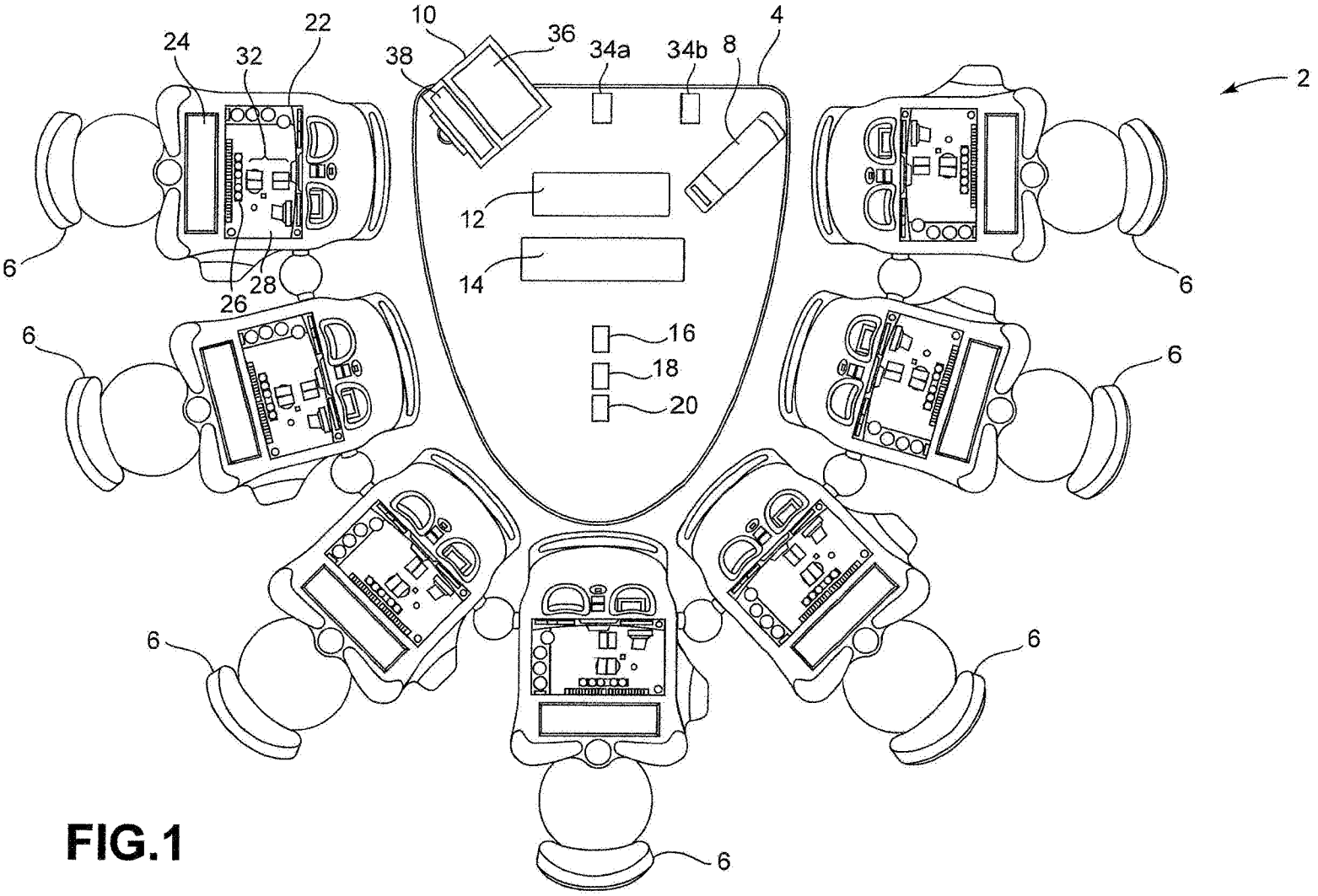
FIG. 1 is a top view of a gaming table system within the scope of the present invention.

A method and system for altering delivery of random events on a gaming table and a system for enabling that method. The system provides random individual physical playing cards, random sets (e.g., hands or partial hands) of physical playing cards to the gaming table and/or to a playing card reading system. If the physical playing cards are not delivered to player positions, the read suit and ranks of the playing cards are displayed as images for the individual player positions, and/or for dealer or banker positions. The method may be practiced by:

a) providing a gaming system (on a playing card table, for example, which may include electronic components for image display and/or wagering) that includes:

a. a playing card moving system that moves individual playing cards from a first physical position to at least a second physical position;

The playing card moving system may include playing card delivery shoes (e.g., with electromechanical drives or even manually driven drives, such as thumb drive wheels), shuffling or randomization machines, and the like. Systems such as those referenced in above may be riffling shufflers, carousel randomization systems, platform randomization systems, random mixing systems, or random ejection systems and the like. The systems, as later explained, may merely move cards within the electromechanical components (e.g., forward and backward randomly) with intermediate reading of playing cards to prevent random outcomes or the systems (e.g., a single system) may be modified (by placing an intermediate playing card delivery system in place of one randomizing function on a symmetrical, two chamber, randomizing system) may be modified to provide the physical playing cards for manual or automated (robotic) delivery to player/banker/dealer positions.

b. a playing card reading system that reads suit and rank of the individual playing cards during movement of the individual playing cards from the first physical position to the at least second physical position;

As noted above, many different technologies, phenomena, systems, and modalities can be used to read playing card suits and ranks. This includes the most modern systems (as described in U.S. Pat. No. 8,969,802, Blazevic, which is incorporated by reference in its entirety) that can actually read through playing cards, CMOS scanners, full image cameras, heuristic self-educating symbol recognition systems, and the like.

c. the playing card reading system transmitting read suit and rank values to a processor;

d. the processor identifying, creating or recording a random order or distribution of playing cards;

There are many commercially available processors used in the gaming industry that can implement these steps. These components are described in the list of devices disclosed earlier herein.

e. the gaming system displaying random combinations of playing cards to at least respective multiple independent player positions on a gaming table by i) providing random physical playing cards from the at least second physical position or ii) the processor transmitting information to a display system visible at each of the at least respective multiple independent player positions on a gaming table;

The random playing cards may be used in any gaming event such as baccarat, blackjack, poker and variants thereof.

After displaying of at least one random combination of playing cards to at least respective multiple independent player positions on a gaming table by i), mode of delivery of a second random combination of playing cards to at least respective multiple independent player positions on a gaming table is performed by ii), or wherein after displaying of at least one random combination of playing cards to at least respective multiple independent player positions on a gaming table by ii), mode of delivery of a second random combination of playing cards to at least respective multiple independent player positions on a gaming table is performed by i).

The system may be constructed with many variations within available and functional structures. One system may provide a closed symmetrical set of shuffling/randomization systems, wherein one (left side) shuffling system feeds randomized playing cards into a central collection area. These collected cards are then fed into a second (right side) shuffling system which returns a newly randomized set of playing cards back into the central collection area. Shufflers that have two forward compartments (on a same side of a carousel) where cards are placed into one compartment for infeed, and then returned to the other same-side compartment for delivery can be used face to face. The forward delivery compartment on one system may be combined into the forward delivery compartment of a second system to create such a symmetrical system. This could create a closed system where cards either need not be manually handled, or cards need only be transferred from the (or one) output chamber/well into the appropriate infeed chamber/well. In such a system, one of the symmetrical shuffling components can be removed and the cards then manually delivered rather than electronically read and the read suit and ranks transmitted to a display area.

The method and system may have a mode of delivery i) performed by an electromechanical playing card moving device configured to provide random combinations of physical playing cards by providing either individual random physical playing cards to a delivery tray for manual delivery or providing sets of multiple physical playing cards to a delivery tray for manual delivery. The electromechanical playing card moving device may be an electromechanical playing card shuffling device with a playing card delivery tray. The electromechanical playing card shuffling device physically moves individual physical playing cards from the first position into individual, single-playing card-retaining compartments. The individual, single-playing card-retaining compartments are carried on a rotating carousel or the individual, single-playing card-retaining compartments are carried on a vertically moving platform array of compartments.

The method and system may have the suit and rank of individual playing cards are read before insertion into the individual, single-playing card-retaining compartments or the suit and rank of individual playing cards are read after withdrawal from the individual, single-playing card-retaining compartments. Upon reading a specific suit and rank on an individual playing card, that individual playing card may be inserted into a single-playing card-retaining compartment which the processor identifies as dedicated for retention of individual playing cards of that specific suit and rank, or upon reading a specific suit and rank on an individual playing card, that individual playing card is inserted into a random single-playing card-retaining compartment which the processor identifies as retaining an individual playing card of that specific suit and rank.

Figure 2:
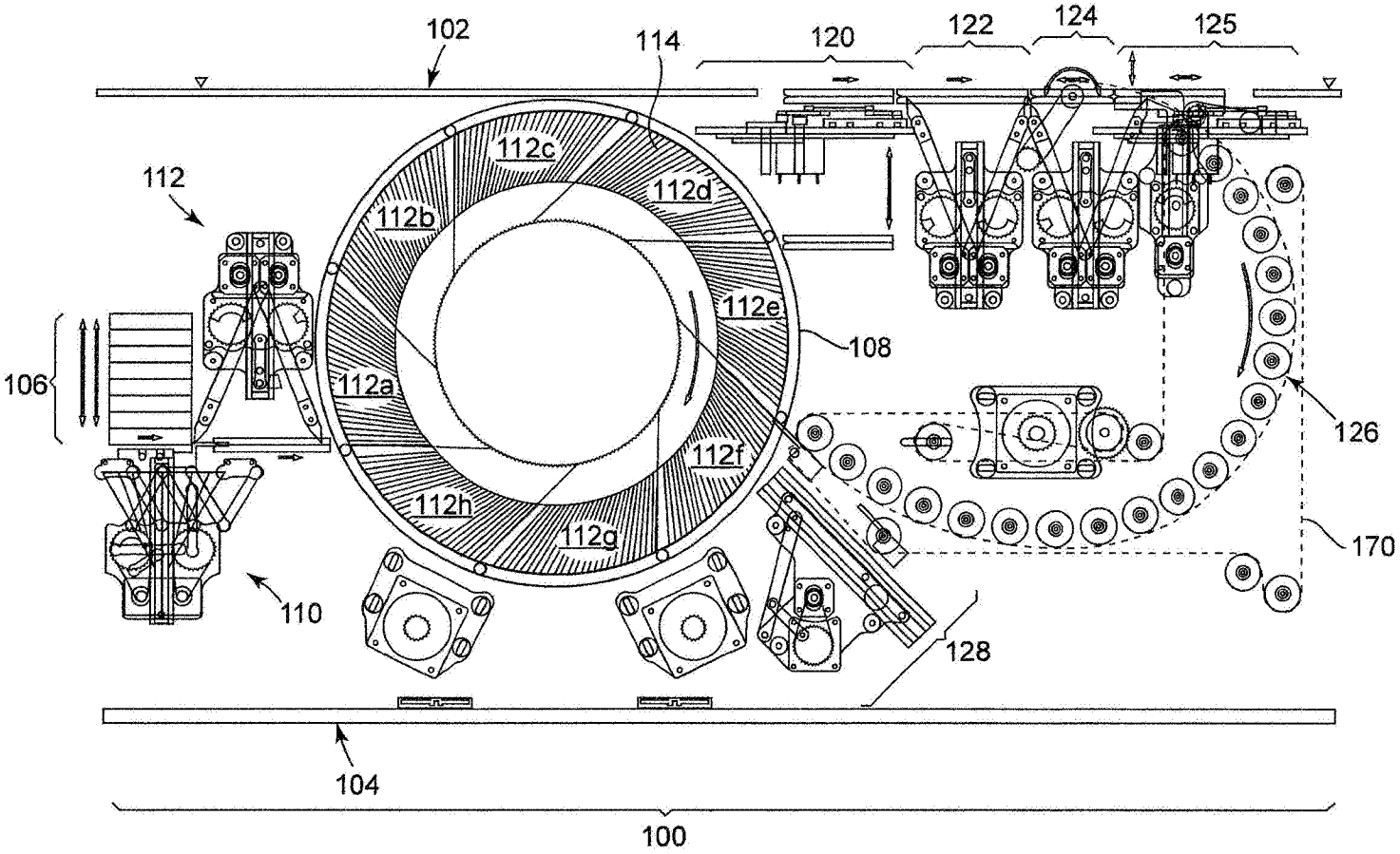
FIG. 2 is a side cutaway view of the shuffling and card return system within the scope of the present technology using a carousel randomization system.
Figure 2A:
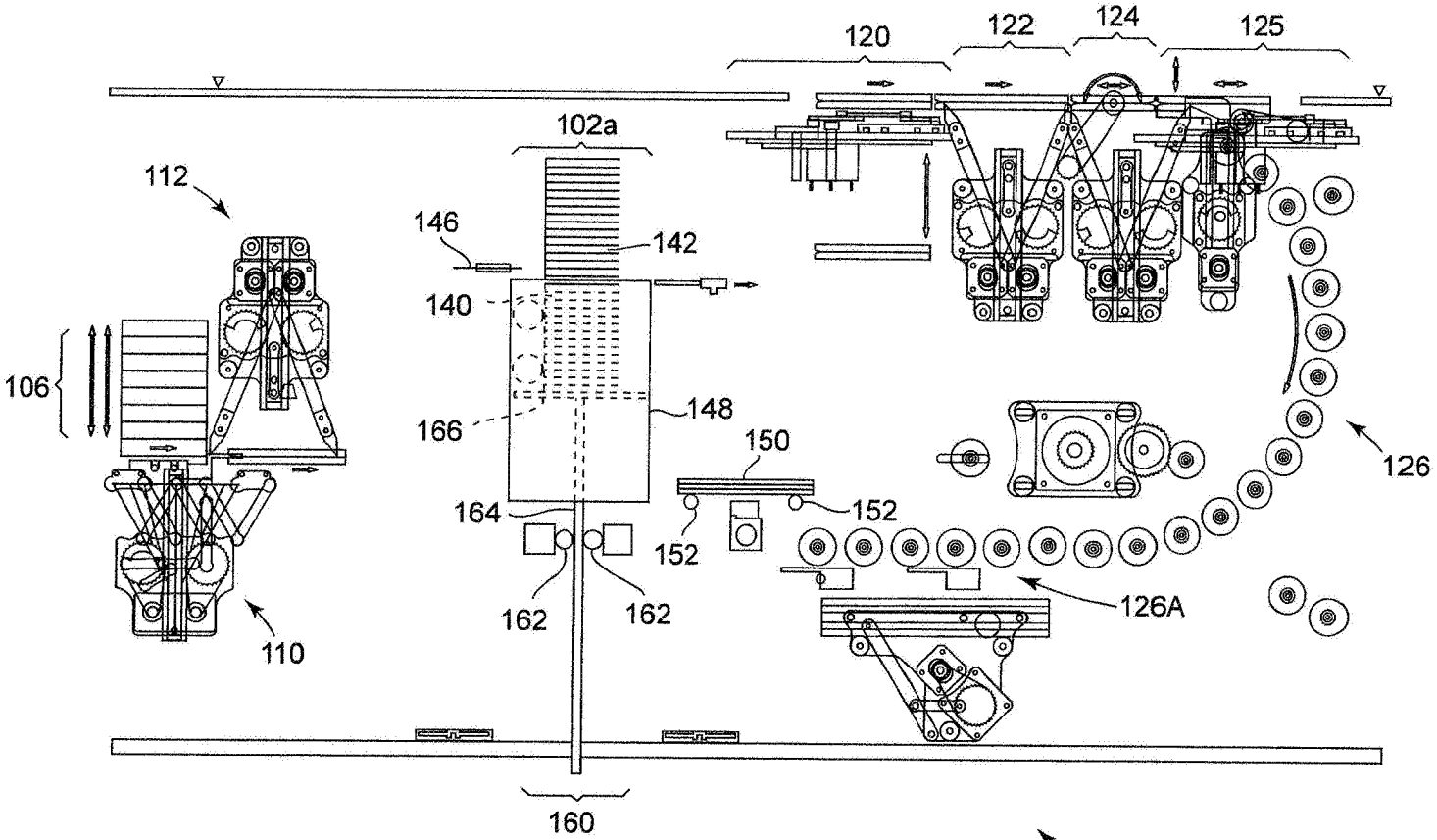
FIG. 2A is a side cutaway view of the shuffling and card return system within the scope of the present technology using a stacked array of compartments for a randomization system.

FIG. 1 is a top view of a self-contained gaming table system 2 useful within the practice of the present invention. The gaming table system 2 includes at least a gaming table 4, multiple player seats 6, multiple player display/input systems 22, dealer/pit crew display and input system 10 on or otherwise accessible from the table 4 and other possibly optional or alternative components. Among these optional or alternative components may be, for example, the three individual playing card or playing card set exposure openings 16, 18 and 20 in the table 4, which as later explained in the descriptions of FIGS. 2 and 2A, show random individual playing cards provided by a sub-table randomization/shuffling device (not shown in FIG. 1, but shown in FIGS. 2 and 2A). An optional playing card delivery shoe 8 is shown for when the system has switched from a fully automated system (no dealer to manually deliver playing cards) to a blended mixed manual-electronic system with a dealer physically delivering playing cards from the shoe to player positions or merely displaying cards and hands using cards from the delivery shoe 8. The dealer input/display screen 10 is shown with two distinct components, which may be either a combination of player display 38 and dealer display 36, or dealer display 38 and dealer input 36 sections. Areas 12 and 14 may be display or advertising or paytable displays or game rule displays or electronic displays to show game content information, such as player hands, dealer hands, strategic advice to players, and the like. Areas 34*a* and 34*b* may be playing card insert areas 34*a* dealer input controls 34*b* and the like. The game table system 2 provides significant flexibility and security in the play of games. For example, preshuffled sets of playing cards in locked containers (a rectangular box) are used on some gaming tables, especially high-stakes tables to assure randomness and prevent player or dealer interference with delivery. These locked containers may have smart chips on them, such that the order of the randomized playing cards is programmed onto the smart chips. The smart chip, through a reader in the delivery shoe 8 transmits the order of the playing cards to a processor (e.g., not shown but for example an under-table placed processor) which then transmits banker/player hands or individual player and dealer hands to display systems such as the player monitors 22, specific hand/card display areas 32 on the display screen 22, community display areas 12 and 14 and even large screen displays (not shown) behind the dealer position which is behind the areas 34*a* and 34*b*.

The individual player monitors 22 may further be associated with a game content display screen or input touchscreen 24, player buttons 26 and additional information area 28 on the player monitors 22.

FIG. 2 is a side cutaway view of a randomization and card return system 100 within the generic scope of the invention using a carousel randomization system.

The entire system is 100. There is a table top 102 and an underlying support 104 within the table.

There are chambers or a single support 106 for providing/storing up to eight decks of playing cards. (a potential table top access is shown in FIG. 1 as element 34*a*, for example) There is a dual motor system for moving individual playing cards from first motor 110 the bottom of the chambers 106 and then another motor 112 for moving the individual cards into the carousel 108. The playing cards are placed individually into the carousel and either individually into compartments (e.g., one card only into compartments such as 114) or as subsets of cards (one or more cards to be provided through the system). The (for example, eight) decks may be randomly distributed among the (for example) eight idealized segments 112*a*-112*h* of the carousel 108, or individual decks may be maintained within individual segments 112*a*, 112*b*, 112*c* . . . 112*h* of the carousel 108. The separation of the decks can speed up play of games, especially single deck games, played on the system 100. One of the individual segments (112*d*) is shown with the individual compartments 114 for receiving individual cards, or when programmed, multiple cards usually delivered as sets of cards from the individual compartments 112*a* . . . 112*h*. The image/values of the cards are individually read and the position of each card within the carousel is known at all times by a processor (not shown).

The carousel 108 rotates and individual cards are ejected into the first intermediate card-carrying system 120, and then individual subsets of playing cards are collected/provided in first card set orientation compartment 122, then individual cards are exposed and read between the first intermediate compartment 122 and the second intermediate compartment 124 where card faces are exposed to confirm the card rank/suit to players. Individual cards are then captured by return transportation capture component 125 is an area with a waiting face-down dealer card that is delivered into the card-return transportation carrier 126 to be reinserted by card return motor 128 back into the carousel 108. These elements and areas 120, 122 and 124 and/or 126 can be seen in another context in FIG. 1 as card display areas 16, 18 and 20 on the table system 2.

A processor (not shown) receives information on the suit and rank of the individual playing card as they are originally inserted into the carousel, removed from the carousel for exposure/reading during the game, and/or upon being returned into the carousel 106 by the carousel return motor 128. In this way, the game play information is recorded and stored, and where there is a display system (as in FIG. 1) for display of the cards and hands during the game, the hands and cards and their respective intended positions (player's hands and dealer/banker hands) can be accurately displayed. Alternatively, as previously mentioned with respect to FIG. 1, the playing card suit and rank information may be downloaded, programmed into a smart chip on a container inserted into a smart delivery shoe (e.g., 8 in FIG. 1) and that information displayed on the player display screens 22 as cards are removed from the delivery shoe 8 in FIG. 1 by a live dealer moving and removing playing cards.

Along the transportation carrier 126, either a pathway of opposed rollers, conveyor belt, or combination of opposed belt(s) and rollers may be used to carry individual playing cards, or provide subsets of playing cards for display, distribution or confirmation of events.

The system, because the processor is 'aware' of the individual playing cards (by internal camera reading or programmed smart chip reading, etc.), can operate in many different modes. For example, as cards may be ejected randomly upon direction of the processor during game play, the cards may be ordered within the individual segments 112*a*-112*h* such as cards are often provided in boxed sets of playing cards, with each of the four suits as A, K, Q, . . . 4, 3, 2. Random ejection from individual slots may therefore alone provide the randomness. The cards would then probably be returned to their original compartments by rotation of the carousel 108 into alignment with the carousel return motor 128.

Alternatively, individual decks may be randomly distributed within each of the individual segments 112*a*-112*h* of the carousel 108, and random delivery of cards by direction of the processor overlays an additional potential level of randomization. Cards from individual deck segments would then likely be returned to their respective segments into open compartments.

Again alternatively, all of the decks may be randomly distributed among all of the individual segments 112*a*-112*h* of the carousel 108, and random delivery of cards by direction of the processor overlays an additional potential level of randomization. Cards from individual deck segments would then likely be returned to any open compartment, with the card values (e.g., suit and rank) identified/scanned/read before or during reinsertion into the carousel 108. Playing cards are individually returned from transportation capture component 125 and then transported by rollers 126 and/or conveyor belt 170 for reinsertion by carousel return motor 128.

A method for altering delivery of random events on a gaming table according to the present invention may include generic steps of:

An electromechanical gaming system associated with a single gaming table receives multiple sets of playing cards in a first physical position. The system moves individual playing cards from the first physical position to at least a second physical position. A playing card reading system reads suit and rank of the individual playing cards during movement of the individual playing cards from the first physical position to the at least second physical position. The playing card reading system transmits read suit and rank values to a processor. The processor identifies, creates or records a random order or distribution of playing cards.

The gaming system may then proceed along two distinct paths. One path is displaying the random order or distribution of playing cards to individual player positions on a video display. Player wagers are automatically resolved at each player position by the processor. Wagers are resolved by the processor comparing the random order or distribution of playing cards at individual player positions against a paytable or against a random order or distribution of playing cards at a dealer position. Playing cards, once inserted into the gaming system are not touched by human hands during play of a round of play of a wagering event performed by the gaming system.

An alternative method and system displays random combinations of playing cards to at least respective multiple independent player positions on a gaming table by i) providing random physical playing cards from the at least second physical position to a display system visible at each of the at least respective multiple independent player positions on a gaming table. After displaying of at least one random combination of playing cards to at least respective multiple independent player positions on a gaming table by physical delivery of playing cards, a mode of delivery of a second random combination of playing cards to at least respective multiple independent player positions on a gaming table is performed by visual display of a virtual hand at each independent player position, in the same round of gaming event play or in a subsequent round of play.

An even more generic process on a gaming table can be considered, without human contact with playing cards, as mechanically moving individual playing cards from a complete set of multiple sets of playing cards into compartments holding only individual playing cards. Individual cards are mechanically removed from individual compartments in a multiple compartment component and disclosed for public view on the gaming table. A playing card reader system identifies at least one of suit and rank of each individual playing card, and the at least one of suit and rank are received by a processor which associates each individual at least one of suit and rank with an individual player position at the gaming table. Completing a hand of playing cards at the player position and the processor recognizing at least one of suit and rank of all playing cards in the hand at the player position. The processor causing a display system at the gaming table to display the hand of playing cards at the player position. The processor recognizing a wager at the player position for a single round of play in a wagering event. The processor resolving the wager at the player position using the recognized at least one of suit and rank of all playing cards at the player position against a paytable or comparison of at least one of suit and rank of all playing cards at the player position against at least one of suit and rank of all playing cards at a dealer position. After resolution of the wager, all playing cards used in the single round of play are returned to empty individual compartments in the multiple compartment component before initiating a subsequent single round of play.

A further generic method included within the scope of the present invention is described as storing at least one complete deck of playing cards (preferably multiple decks up to eight decks, for example) in a multiple compartment providing component (e.g., the stacked array of compartments or the carousel of compartments). Individual playing cards of the at least one deck are stored in individual compartments of the multiple compartment providing component. Random individual playing cards within the multiple compartment providing component are removed from compartments and their rank and suit are stored by a processor and exposed for view at the gaming table. The rank and suit of individual removed playing cards are associated with the individual player position. Final hand count or rank at the player position are determined by the processor at the individual player position. A wager recognized by the processor is resolved by the processor based on the rank and suit of individual removed playing cards associated with the individual player position. The rank and suit of individual removed playing cards associated with the individual player position are compared by the processor a) to a paytable or b) against at least one other hands associated with another individual hand position. After resolution of the wager, all playing cards used in the single gaming event are returned individually to individual playing card compartments in the multiple compartment providing component.

FIG. 2A shows an alternative game table system 100 in which the underlying playing card randomization and provisions system 160 is an elevator or linear array of compartments system 102*a*. Identical numbers among FIG. 2 and FIG. 2A represent identical or similar elements. Primary differences between the systems of FIG. 2 and FIG. 2A are in elements 102, 160, 126A, 140, 142, 146, 148, 150, 152, 164 and 166.

In the operation of the system 100 of FIG. 2A, playing cards are moved from the input array of compartments. Sets 106 and moved, injected into the linear stacked array 102 of individual storage compartments 142, as by an proximal side injector/ejector 146. The proximal side injector/ejector pushes individual playing cards into individual compartments 142 in the stacked array 102*a*. The proximal side injector/ejector 146 may also eject individual cards or sets of cards so that they are lifted, inserted, moved into the further card moving and displaying elements 120, 122, 124 and 125. This may be done by additional elevators, rollers, conveyors and/or the like (not shown, as a generic card moving component is allowed).

The main differences are that the individual cards are stored and provided out of the vertical array 102 of compartments 142. The compartments 142 are positioned for insertion and ejection by powered rollers 162 and/or powered or unpowered rollers 140 driving the stacked or vertical array 102 of compartments 142 upward and downward by driving a piston/support shaft 164 which further moves a platform 166 which supports the stacked array 102 of individual compartments 142 up and down with respect to the inserter/ejector 146 and the card reinsertion component 150. Driver rollers 152 that push/transport cards in the card reinsertion component 150 into individual compartments 142 appropriately positioned by height changes implemented by shaft 164 and platform 166 vertical movement within the housing 148. An opening or slot (not shown) would be in the housing to allow card movement into or out of the housing 148. Note that the final rollers 126*a* tend to be more horizontal in FIG. 2A than similarly positioned rollers 126 in FIG. 2, although some upward or downward slope is acceptable.

Many different types of casino table games can be played on the present system, with significant advantages in economy provided to the casino by the use of the present system. Both multi-deck and single-deck game play can be enabled on the same system, with the multi-deck system operating as a continuous mode shuffler so that cards from an immediately preceding round of play may be inserted before, during or after the next round of play to assure that there is no exhaustion factor of specific playing cards (by suit and/or rank) because of the an earlier played hand.

By using the individual sections (e.g., FIG. 2, 112*a* . . . 112*h*) to contain individual decks, the players can observe changes in colors on the backs of decks, giving them assurance that (as in typical single deck play) different decks are used in consecutive rounds of play. By using more than two (up to eight for example) decks, eight consecutive different decks (as evidenced by their different backs) can be used and be observed by the players as being used.

As shown in FIG. 1, and initial display of baccarat or first two cards in blackjack (e.g., with one dealer card face-down) may be represented in the two hand display area 32. In play of other wagering events or games, more cards or fewer cards may be displayed at particular locations. A benefits of the card movement and/or card display areas 16, 18 and 20 is that players can observe that the cards being shown on their display screens 22 during play correspond to the physical cards being provided by the systems (100 in FIGS. 2 and 2A) in the card movement and/or card display areas 16, 18 and 20. This can overcome some resistance of players to use electronic game play, as there are many individuals who believe that processors will be programmed specifically at a disadvantage to players, even at house advantage rates higher than that of the underlying probabilities of a game. This feature will ameliorate such concerns of certain groups of players.

The dealer input control 34*b* can implement many features of the system described herein. That dealer input control 34*b* may be the coded, keyed or otherwise secure input control enabling the shift between fully automatic gaming table play (where the dealer shoe 8 is not used) and semi-automated play using the delivery shoe 8 with cards from the internal randomization system of the invention or delivered containers of pre-randomized playing cards (preferably with smart chips, QR codes, bar codes, or other accessible information) whose order information can be provided to a processor on the table. The dealer input control 34*b* may even control or switch the source of playing card information provided to the processor as well as switch modes of play from automatic to semi-automatic.

The present system enables play of essentially any card game, with single or multiple decks of cards, and can enable underlying wagers, subsequent wagers, side bets, jackpot wagers, and progressive jackpot wagers through the main or game processor, internet connections and player input. Wagering events such as baccarat, blackjack, poker and their many variants may be executed on the present system, with side bets or not. The present system offers significant simplicity and ease of maintenance as compared to the above described U.S. Pat. No. 8,360,431.

The present system, in its simplest and most generic system form may be described as a gaming table, with an under the table electromechanical, automatic playing card randomization and playing card moving and reading system, and visible display system(s) for player positions. Random playing cards are moved in the generic system to provide both a visible view of individual playing cards as they are being "delivered" to player and/or dealer positions, while also reading the value, count and/or rank of the playing cards, transmitting those read value, count and/or ranks to a processor, and displaying those read value, count and/or rank to the player positions, as through a display system (e.g., screens, terminals, boards, in-table displays, over/behind table displays, large screen monitors and the like) available to each and every player position. The generic system is configured as an automatic system, with players at each player position being enabled to play individual hands during sequential or single rounds of play and/or steps within rounds of play, without a live dealer. Wagers are automatically entered at player terminals and are resolved by the processor with knowledge of gaming event rules, and knowledge of individual and collective cards at each player position and dealer/banker positions if present. The processor will also store look-up tables where paytables are used in the wagering event, and will execute an accounting function to credit and decrement player credits in wins, losses and pushes on gaming events.

The functionality of being able to switch easily to a semi-automatic gaming system by linking a random—playing card providing system through a communication link on the table with the processor is a significant benefit. As noted any random playing card providing system (delivery shoes, shufflers, randomization systems, containers of preshuffled cards) in which the order of the random playing cards is known or read at the table (by readers in the delivery shoes/shufflers, on the delivery shoes/shufflers, in front of the delivery shoes/shufflers, on the gaming table surface and the like) can be used in implementing the semi-automatic mode. An I/O port, USB port, or any other communication linkage between the random playing card delivery system, the table and the processor can be provided as a structural feature on the table. The random playing card delivery system may snap into the communication link on the table, may have a cable connection to the link or may communicate by wireless transmission (e.g., near filed communication or WiFi) to transmit playing card suit/rank/count information to the processor.

These features and alternative modifications will be apparent to those skilled in the art, yet remain within the generic scope of process and apparatus and systems within the present invention.

What is claimed:

1. A method for altering delivery of random events on a gaming system including a gaming table, the method comprising:

moving, by a playing card moving system, individual physical playing cards from a first physical position within the gaming system to one or more additional physical positions within the gaming system, wherein during a single round of play of a gaming event in each of the first physical positions and the one or more additional physical positions the individual physical playing cards are only touched by the playing card moving system;

reading, by a playing card reading system, a suit and a rank of each individual physical playing card during movement of the individual physical playing cards from the first physical position to the one or more additional physical positions;

transmitting values for each read suit and rank to a processor;

at the processor, identifying, creating or recording a random order or distribution of the individual physical playing cards;

receiving wagers from each of one or more independent player positions associated with and physically separated from the gaming table to initiate the beginning of the single round of play of the gaming event that concludes with resolution of each received wager, delivering, to each of the one or more independent player positions, a first random combination and a second random combination of individual playing cards, wherein the first random combination and the second random combination of individual playing cards are delivered in the single round of game play through different modes of delivery, and wherein resolution of each received wager is based on the first random combination and the second random combination of individual playing cards at the independent player position, at each independent player position, after receiving wagers, displaying the first random combination of the individual physical playing cards to each of the one or more independent player positions by a first mode of delivery comprising providing the first random combination as physical playing cards in a card display area of the gaming table visible from each independent player position or a second mode of delivery comprising the processor transmitting information regarding the first random combination as virtual playing cards on a display visible from the independent player position;

wherein, during the single round of play, when displaying the first random combination to each of the one or more independent player positions solely by the first mode of delivery, displaying the second random combination of the individual physical playing cards to each of the one or more independent player positions solely by the second mode of delivery, wherein, during the single round of play, when displaying the first random combination to each of the one or more independent player positions solely by the second mode of delivery, displaying the second random combination solely by the first mode of delivery, and wherein, the first mode of delivery is not the same as the second mode of delivery.

2. The method of claim 1, wherein the playing card moving system is an electromechanical physical playing card moving device configured to provide the first random combination or the second random combination.

3. The method of claim 2, wherein the electromechanical physical playing card moving device comprises an electromechanical playing card shuffling device.

4. The method of claim 3, wherein the electromechanical playing card shuffling device physically moves the individual physical playing cards from the first physical position to a delivery tray for delivery by the first mode of delivery.

5. The method of claim 3, wherein the electromechanical playing card shuffling device includes a plurality of individual, single-playing card-retaining compartments.

6. The method of claim 5, wherein the plurality of individual, single-playing card-retaining compartments are in a rotating carousel or a vertically moving platform.

7. The method of claim 5, wherein the suit and the rank of the plurality of individual physical playing cards are read before insertion into the individual, single-playing card-retaining compartments.

8. The method of claim 5, wherein the suit and the rank of the plurality of individual physical playing cards are read after withdrawal from the individual, single-playing card-retaining compartments.

9. The method of claim 5, wherein each single-playing card-retaining compartment corresponds to a specific suit and rank.

10. The method of claim 5, wherein a specific suit and rank is associated with a random single-playing card-retaining compartment.

11. The method of claim 1, wherein transition from the first mode of delivery to the second mode of delivery or from the second mode of delivery to the first mode of delivery is performed by at least an operator input command to the processor to switch from the first mode of delivery to the second mode of delivery or from the second mode of delivery to the first mode of delivery.

12. A gaming system including a gaming table, comprising:

a) a physical playing card moving system that moves individual physical playing cards from a first physical position within the gaming system to one or more additional physical positions within the gaming system, wherein during a single round of play of a gaming event in each of the first physical position and the one or more additional physical positions, the individual physical playing cards are only touched by the physical playing card moving system;

b) a physical playing card reading system that reads a suit and a rank of each individual physical playing card during movement of the individual physical playing cards from the first physical position to the one or more additional physical positions;

c) the physical playing card reading system configured to transmit values for each read suit and rank to a processor;

d) the processor configured to identify, create or record a random order or distribution of the individual physical playing cards;

e) the gaming system configured, after receiving wagers from each of one or more independent player positions associated with and physically separated from the gaming table initiating the beginning of the single round of play of the gaming event that concludes with resolution of each received wager, to display a first random combination and a second random combination of the individual physical playing cards to each of the one or more independent player positions by a first mode of delivery comprising providing the first random combination as physical playing cards in a card display area of the gaming table visible from each of the one or more independent player positions or a second mode of delivery displaying the first random combination as virtual playing cards on a display visible from each of the one or more independent player positions;

wherein resolution is based on a first random combination and a second random combination of individual playing cards, and the first random combination and the second random combination of individual playing cards are delivered in the single round of game play through different modes of delivery, and wherein the gaming system is further configured so that, in the single round, after displaying the first random combination solely by the first mode of delivery, the gaming system can be converted to display the second random combination of the individual physical playing cards solely by the second mode of delivery by changing a functional operation of the physical playing card moving system, or wherein, in the single round, after displaying the first random combination solely by the second mode of delivery, the gaming system can be converted to display the second random combination solely by the first mode of delivery by changing the functional operation of the physical playing card moving system.

13. The gaming system of claim 12, wherein the physical playing card moving system is an electromechanical playing card moving device configured to provide the first random combination or the second random combination.

14. The gaming system of claim 13, wherein the electromechanical playing card moving device comprises an electromechanical playing card shuffling device.

15. The gaming system of claim 14, wherein the electromechanical playing card shuffling device physically moves each of the individual physical playing cards from the first physical position to one or more of a delivery tray and individual, single-playing card-retaining compartments.

16. The gaming system of claim 15, wherein a plurality of the individual, single-playing card-retaining compartments are carried on a rotating carousel or a vertically moving platform.

17. The gaming system of claim 15, wherein the delivery tray facilitates manual delivery of each individual physical playing card.

18. The gaming system of claim 16, wherein the suit and the rank of the individual physical playing cards are read before insertion into the individual, single-playing card-retaining compartments.

19. The gaming system of claim 16, wherein the suit and the rank of the individual playing physical cards are read after withdrawal from the individual, single-playing card-retaining compartments.

20. The gaming system of claim 16, wherein each single-playing card-retaining compartment, which corresponds to a specific suit and rank, and is identified by the processor as being dedicated for retention of individual playing cards of that specific suit and rank.

21. The gaming system of claim 16, wherein a specific suit and rank is associated with a random single-playing card-retaining compartment.

22. The gaming system of claim 18, wherein displaying by the first mode of delivery is a form of fully automatic play and displaying by the second mode of delivery is a form of semi-automatic play.

* * * * *